United States Patent [19]

Nakamura et al.

[11] Patent Number: 4,856,829

[45] Date of Patent: Aug. 15, 1989

[54] PAWL STRUCTURE IN A DOOR LOCKING DEVICE FOR A VEHICLE

[75] Inventors: Hitoshi Nakamura; Yasuaki Hori, both of Yokohama, Japan

[73] Assignee: Ohi Seisakusho Co., Ltd., Kanagawa, Japan

[21] Appl. No.: 156,171

[22] Filed: Feb. 16, 1988

[30] Foreign Application Priority Data

May 20, 1987 [JP] Japan ..... 62-121395

[51] Int. Cl.[4] ..... E05C 3/26

[52] U.S. Cl. ..... 292/216; 292/DIG. 38; 292/DIG. 56; 292/DIG. 73

[58] Field of Search ..... 292/216, DIG. 38, DIG. 56, 292/DIG. 73

[56] References Cited

U.S. PATENT DOCUMENTS

| | | | |
|---|---|---|---|
| 3,610,668 | 10/1971 | Tixier | 292/DIG. 38 X |
| 4,130,308 | 12/1978 | Jeavons | 292/216 |
| 4,235,462 | 11/1980 | Torii et al. | 292/DIG. 38 X |
| 4,358,141 | 11/1982 | Hamada | 292/DIG. 38 X |
| 4,375,039 | 11/1982 | Tölle | 292/DIG. 56 X |
| 4,538,845 | 9/1985 | Yamada | 292/DIG. 38 X |
| 4,756,564 | 7/1988 | Ikeda | 292/DIG. 38 X |

FOREIGN PATENT DOCUMENTS

| | | | |
|---|---|---|---|
| 2725345 | 12/1978 | Fed. Rep. of Germany | 292/216 |
| 53-138127 | 12/1978 | Japan . | |
| 58-11277 | 1/1983 | Japan . | |
| 58-11878 | 3/1983 | Japan . | |
| 60-44964 | 3/1985 | Japan . | |
| 369040 | 6/1963 | Switzerland | 292/DIG. 38 |
| 1197006 | 7/1970 | United Kingdom | 292/DIG. 38 |

*Primary Examiner*—Peter R. Brown

*Attorney, Agent, or Firm*—Helfgott & Karas

[57] ABSTRACT

A pawl structure in a door locking device for a vehicle in which a latch member is rotatably supported, comprising a claw member engaged with the latch member to prevent the latch member from being rotated, the claw member including a claw portion and a resin portion engaged with the latch member and made of resin and covering at least a portion of the claw portion; and a base shaft member connected to the claw member and pivotally connected to the door locking device and having a base shaft portion substantially perpendicular to the claw portion of the claw member, and a resin portion made of resin and covering at least a portion of the base shaft portion.

5 Claims, 3 Drawing Sheets

FIG.4B
FIG.4A
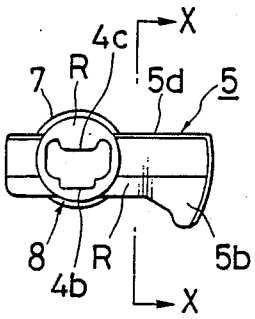
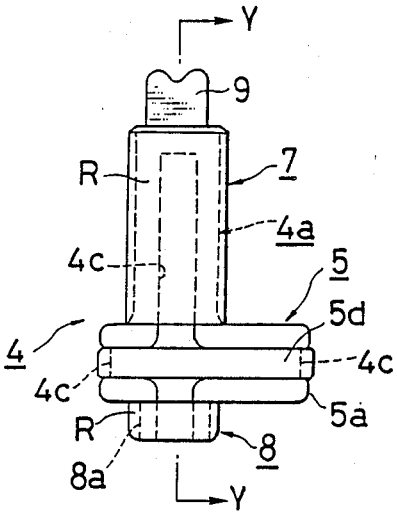
FIG.4C
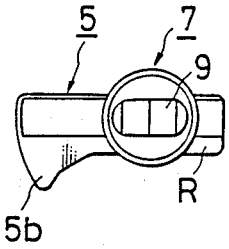
FIG.5A
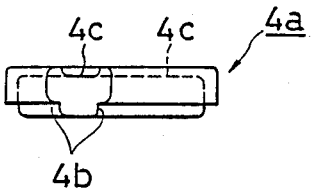
FIG.5B
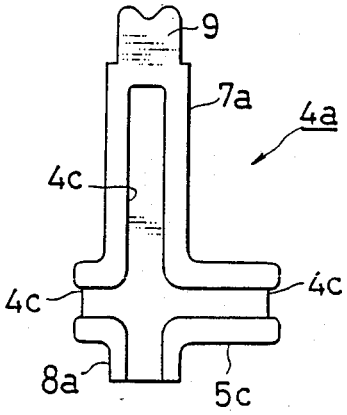

PAWL STRUCTURE IN A DOOR LOCKING DEVICE FOR A VEHICLE

The present invention relates to a pawl structure in which a pawl is engaged with a latch in a door locking device for a vehicle to prevent the latch from being rotated or released.

BACKGROUND OF THE INVENTION

In general, a door for a vehicle is opened and closed by engaging a striker fixed onto a vehicle body side with a latch disposed in a locking device on the door side. The latch is prevented from being rotated by engaging it with a pawl pivotally supported and biased in a direction in which the pawl is engaged with the latch.

As shown in FIG. 1, in such a conventional pawl structure, the pawl is integrally formed by cutting work with a base shaft 10, a link connecting portion 11, a claw portion 12, and a bearing portion 13. Japanese Laid-Open Patent No. 58-11277 discloses another pawl structure in which a raw material punch-molded from a metallic flat panel is formed by pressing work in the respective shapes of the base shaft, the link connecting portion, the claw portion, etc.

However, in the pawl structure shown in FIG. 1, it is necessary to perform machining works in some processes, thereby increasing the manufacturing cost. Further, it is difficult to make the pawl structure compact by the requirements of the mechanical strength and durability. Further, since the entire structure is integrally formed by a metallic material, the weight of the structure cannot be reduced and is limited, and a high hitting sound peculiar to the metal is generated when the pawl contacts the latch.

In the pawl structrue in which a material after punching is molded by pressing work, it is necessary to perform the pressing work at some stages, and further to prepare various kinds of dies for pressing the material to form the respective shapes of the base shaft, the link connecting portion, the claw portion, etc., thereby increasing the manufacturing cost. Further, similar to the structure mentioned above, the structure is integrally made of a metallic material so that a hitting sound is generated when the pawl contacts the latch.

SUMMARY OF THE INVENTION

To overcome the problems mentioned above, an object of the present invention is to provide a pawl structure in a door locking device for a vehicle in which the structure is made compact and light and the manufacturing cost is reduced and a hitting sound of a pawl is reduced.

With the above object in view, the present invention resides in a pawl structure in a door locking device for a vehicle in which latch means is rotatably supported, said structure comprising claw means engaged with the latch means to prevent the latch means from being rotated, said claw means including a claw portion and a resin portion engaged with the latch means and made of resin and covering at least a portion of the claw portion; and base shaft means connected to the claw means and pivotally connected to the door locking device, said base shaft means having a base shaft portion substantially perpendicular to the claw portion of the claw means, and a resin portion made of resin and covering at least a portion of the base shaft portion.

BRIEF DESCRIPTION OF THE DRAWINGS

The present invention will be more apparent from the following description of the preferred embodiments thereof in conjunction with the accompanying drawings in which:

FIGS. 4A to 4C are respectively front, plan and rear views of the pawl structure of the present invention;

FIGS. 5A and 5B are respectively front and plan views showing a core material of the pawl structure of the present invention;

DETAILED DESCRIPTION OF THE PREFERRED EMBODIMENTS

The preferred embodiments of the present invention will now be described with reference to the drawings.

Figure 2:
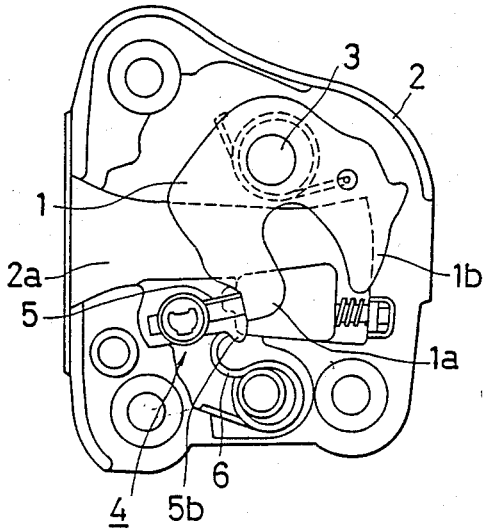
FIG. 2 is a front view of a door locking device to which the present invention is applied.

FIG. 2 shows a front portion of a door locking device on a latch side thereof in which a pawl structure of the present invention is used. A latch 1 is rotatably attached to a box-shaped body 2 made of synthetic resin and fixed to an unillustrated base plate, around a shaft 3 as a center. The latch 1 is biased by an unillustrated spring in the clockwise direction at any time.

A pawl structure 4 is rotatably supported by the body 2, and a rear end of the pawl structure 4 extends through the base plate and is then connected to an unillustrated open lever on the rear side.

A claw 5 of the pawl structure 4 is engaged with left and right leg pieces 1*a* and 1*b* of the latch 1. When the claw 5 is engaged with the left leg piece 1*a*, the device is in a full latch state, and when the claw 5 is engaged with the right leg piece 1*b*, the device is in a half latch state.

A spring 6 is engaged with the pawl structure 4 to bias the pawl structure 4 in the counterclockwise direction.

A guide groove 2*a* is transversally formed in an intermediate portion of the body 2 to receive an unillustrated striker fixed onto a vehicle body side. A door can be opened and closed by disengaging and engaging the striker inserted into the guide groove 2*a* with the latch 1.

The construction of the pawl structure 4 will next be described in detail.

As shown in FIGS. 3 and 4A to 4C, the pawl structure 4 comprises a base shaft 7 on which a material R made of synthetic resin is molded, and the claw 5 having an engaging end 5*a* approximately projecting from a front end of the base shaft 7 in the diametrical direction and engaged with the leg pieces 1*a* and 1*b* of the latch 1, and partially molded by a material R made of synthetic resin. The pawl structure 4 further comprises a bearing portion 8 disposed adjacent to the claw 5 and molded by a material R made of synthetic resin, and a link connecting portion 9 approximately in the shape of a square pole formed at the rear end of the base shaft 7 and engaged with an unillustrated open lever.

As shown in FIGS. 5A and 5B, the pawl structure 4 comprises a metallic core material 4*a* which is approximately in the shape of a cross in plane and is integral with a plate-shaped base shaft portion 7*a*, a claw portion 5*c*, a bearing portion 8*a* and the link connecting portion 9. Main portions of the core material 4*a* are molded by a material made of synthetic resin to form the base shaft 7, the bearing portion 8 and the claw 5.

An expanded portion 4*b* is disposed on the lower surface of the core material 4*a* to increase the mechanical strength thereof such that a central portion of the expanded portion 4*b* is expanded approximately in the shape of a cross in the longitudinal direction. Further, recessed grooves 4*c* in the shape of a cross are disposed on the upper surface of the core material 4*a* to increase the joining force of the synthetic resin material at the molding time, and are approximately face-symmetrically formed with respect to each other along predetermined lengths.

Figure 1:
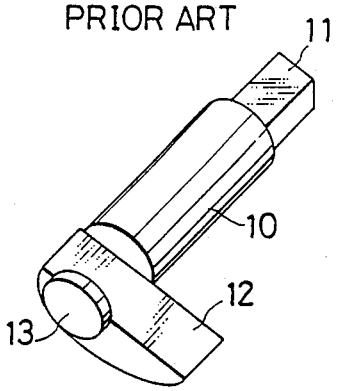
FIG. 1 PRIOR ART
FIG. 1 is a perspective view showing a conventional pawl structure.
Figure 3:
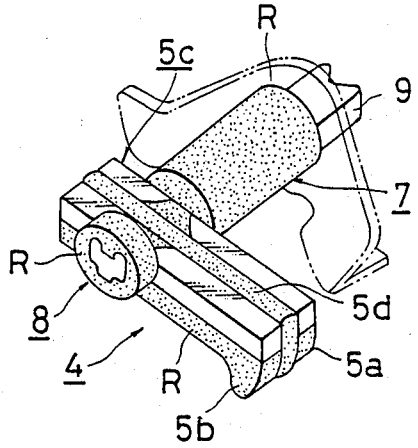
FIG. 3 is a perspective view of a pawl structure in the door locking device of FIG. 2 in accordance with the present invention.
Figure 6:
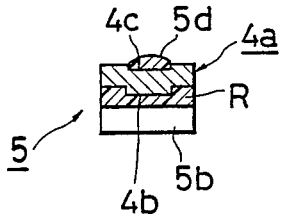
FIG. 6 is a longitudinally cross-sectional view taken along line X—X of FIG. 4A.
Figure 7:
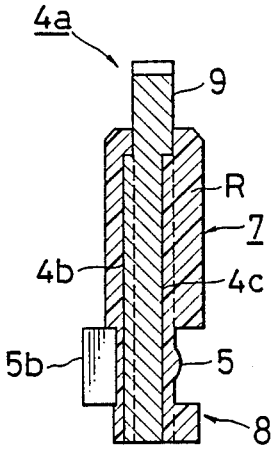
FIG. 7 is a longitudinally cross-sectional view taken along line Y—Y of FIG. 4B.

As shown in FIGS. 3, 6 and 7, the lower surface of the claw 5 engaged with the spring 6 is entirely molded by synthetic resin having a predetermined thickness. A downward projection 5*b* is integrally formed at the right end of the claw 5, and is engaged with the spring 6 and is provided with the engaging end 5*a* engagable with the latch 1.

The end surface of the engaging end 5*a* is formed in the shape of a circular arc to easily engage and disengage this end surface from both leg pieces 1*a* and 1*b* of the latch 1.

A cross-shaped material 5*d* made of synthetic resin is molded on the opposite surface of the downward projection 5*b* in slide contact with the latch 1 along the recessed grooves 4*c* formed in the core material 4*a*, and has a height slightly higher than the height of the core material 4*a*, as shown in FIGS. 3 and 6. The cross-shaped material 5*d* is connected to the circumferential end surface of the projection 5*b*, i.e., the engaging end 5*a*.

Accordingly, the latch 1 and the claw 5 contact each other through the material made of synthetic resin, thereby preventing the core material 4*a* from directly contacting the latch 1.

As a result, a metallic sound generated between the latch 1 and the claw 5 by the opening and closing operations of a door is reduced, and the frictional resistance therebetween is also reduced so that the door is easily opened and closed, and the latch 1 is easily engaged and disengaged with the claw 5.

The material made of synthetic resin and used for a molded material is preferably selected from a hard nylon material, for example, but may be selected from another resin having excellent wear resistance characteristics and mechanical strength and small frictional coefficient.

The core material 4*a* can be formed by punching a flat panel by a press, etc. in one process so that the number of processing operations is greatly reduced.

It is not necessary to accurately process the core material 4*a* so that the generating rate of defective product is reduced and the yield is improved.

Further, since the base shaft 7 and the bearing portion 8 are molded by a material made of synthetic resin so that the frictional resistance thereof is reduced and the pawl structure 4 is smoothly rotated.

In the embodiment mentioned above, the core material 4*a* is partially molded by synthetic resin with a portion thereof left exposed, but may be entirely molded with only the link connecting portion 9 left so that the metallic portion is covered, which is advantageous to prevent the metallic portion from being rusty and minimizes the treatment for preventing the core material 4*a* from being rusty.

As mentioned above, in accordance with a pawl structure of the present invention, the following effects can be obtained.

(1) The core material as a base material of the pawl structure is integrally formed by punching work, and only the molding processing by synthetic resin is next performed with respect to the core material so that the pawl structure is cheaply manufactured in comparison with the conventional pawl structure.

(2) The core material can be formed so as to minimize the size thereof in consideration of the mechanical strength, etc., and the base shaft, etc. are molded by resin so that the pawl structure is made compact and light, thereby making a door locking device compact and light.

(3) The claw portion engaged with the latch is molded by resin so that a hitting sound generated when the latch and the claw portion are engaged and disengaged from each other is reduced, and the frictional resistance thereof is also reduced when the latch and the claw portion are engaged and disengaged from each other, thereby facilitating the engaging and disengaging operations.

What is claimed is:

1. A pawl structure in a door locking device for a vehicle in which latch means is rotatably supported, said structure comprising:

claw means engageable with the latch means to prevent the latch means from being rotated, said claw means having at least a portion thereof covered with a resin material; and base shaft means extended substantially perpendicular to the claw means and connected to the claw means and being rotatably connected to the door locking device, said base shaft means having at least a portion thereof covered with a resin materail so as to significantly suppress noise between said claw means and said latch means and reduced in said claw means and said base shaft means wear due to friction.

2. A pawl structure as claimed in claim 1, wherein said claw means and said base shaft means are integrally molded together to constitute a core member.

3. A pawl structure as claimed in claim 2, wherein said core member is integrally made of a flat panel by punching work, and the resin material of the claw means and the base shaft means is a hard synthetic resin.

4. A pawl structure as claimed in claim 3, wherein the resin material which covers the portion of the claw means has a contacting portion which contacts the latch means, the contacting portion having a height slightly greater than the height of the core member.

5. A pawl structure as claimed in claim 4, wherein the core member has a a recessed formed in a surface of said claw means, said recess being filled with said resin material so as to form said contacting portion.

* * * * *